US006589137B2

(12) United States Patent
Pyles

(10) Patent No.: US 6,589,137 B2
(45) Date of Patent: Jul. 8, 2003

(54) EXERCISER WITH AN ELEMENT FOR EMITTING A LIGHT BEAM THAT CAN BE USED TO CORRECT POSTURE OF THE USER

(75) Inventor: Nathan Pyles, Lake Mills, WI (US)

(73) Assignee: Peter K. C. Lo, Taichung (TW)

( * ) Notice: Subject to any disclaimer, the term of this patent is extended or adjusted under 35 U.S.C. 154(b) by 161 days.

(21) Appl. No.: 09/927,532

(22) Filed: Aug. 10, 2001

(65) Prior Publication Data

US 2003/0032525 A1 Feb. 13, 2003

(51) Int. Cl.[7] ..... A61B 5/00
(52) U.S. Cl. ..... 482/8; 482/9
(58) Field of Search ..... 482/1–9, 51, 54, 482/91, 95, 96, 100, 133–139, 900–902; 600/587, 594, 595

(56) References Cited

U.S. PATENT DOCUMENTS 5,004,230 A * 4/1991 Jones ..... 482/100
5,954,674 A * 9/1999 Fuhr ..... 600/594
6,273,841 B1 * 8/2001 Johnston ..... 482/51
6,334,837 B1 * 1/2002 Hein et al. ..... 482/8

* cited by examiner

*Primary Examiner*—Glenn E. Richman
(74) *Attorney, Agent, or Firm*—Trop, Pruner & Hu, P.C.

(57) ABSTRACT

An exerciser includes a seat attached to a supporting frame unit, and a swing rod disposed pivotally on the supporting frame unit and adapted to be swung by a portion of a human body so as to rotate synchronously with the portion of the human body about a rotating axis. A light emitting element is mounted on an assembly of the supporting frame unit and the swing rod so as to generate a light beam that extends along the rotating axis. When the human body sits on the seat, the portion of the human body can move on the supporting frame unit so as to align the light beam accurately with the rotating axis of one joint of the human body, about which the portion of the human body rotates.

8 Claims, 14 Drawing Sheets

EXERCISER WITH AN ELEMENT FOR EMITTING A LIGHT BEAM THAT CAN BE USED TO CORRECT POSTURE OF THE USER

BACKGROUND OF THE INVENTION

1. Field of the Invention

This invention relates to an exerciser, such as a back extension machine or a leg extension machine, and more particularly to an exerciser which includes a light emitting element that generates a light beam for correcting the posture of the user of the exerciser.

2. Description of the Related Art

Referring to FIG. 1, a conventional back extension machine is shown to include a supporting frame unit 1, a swing rod 2 disposed pivotally on the frame unit 1, and a counterweight unit 3. The supporting frame unit 1 has a brace 101 that supports a seat 102 fixedly on an upper end thereof. The seat 102 is disposed below the swing rod 2. Two foot plates 103 are disposed fixedly on a lower end portion of the brace 101. The swing rod 2 is provided with a fixed back cushion 201 that is disposed above the seat 102. A pull rope 202 extends around a pulley 203, and is fastened to the swing rod 2 at one end, and to the counterweight unit 3 at another end.

Referring to FIGS. 2 and 3, the user sits on the seat 102 in such a manner that his feet rest on the foot plates 103. To exercise the muscles of the user's back, the back of the user turns the back cushion 201 rearwardly so as to rotate the swing rod 2 synchronously with the back of the user, thereby pulling the counterweight unit 3 upwardly. It should be noted that if the rotating axes of both the swing rod 2 and the back joint of the user are improperly coordinated, the swinging movement of the swing rod 2 will hurt the back muscles and the back joint of the user.

Referring to FIG. 4, a conventional leg extension machine is shown to include a supporting frame unit 4, a swing rod 5 disposed pivotally on the supporting frame unit 4, and a counterweight unit 6. The frame unit 4 is provided with a fixed seat 401, a fixed backrest 402 and a fixed handle unit 403. The swing rod 5 is provided with a shank cushion 501 that is located below the seat 401. A pull rope 502 extends around a pulley 503, and is fastened to the swing rod 5 at one end, and to the counterweight unit 6 at another end.

Referring to FIGS. 5 and 6, the user sits on the seat 401, and grasps the handle unit 403. The back of the user abuts against the backrest 402. To exercise the muscles of the user's legs, the calves of the user turn the shank cushion 510 forwardly and upwardly so as to rotate the swing rod 5 synchronously with the calves of the user, thereby pulling the counterweight unit 6 upwardly. It should be noted that if the rotating axes of both the swing rod 5 and the knee joint of the user are improperly coordinated, the swinging movement of the swing rod 5 will hurt the leg muscles and the knee joint of the user.

To help correct the posture of the user with respect to the swing rod 5, a mark is provided to indicate the correct position of the joint of the user on the exerciser. For example, referring to FIGS. 7 and 8, each of a pair of improved back and leg extension machines includes a colored cap 801, 801', which covers a pivot that connects a swing rod 8, 8' rotatably to a supporting frame unit 7, 7'. The body of the user can move on the frame unit 7, 7' by adjusting the position of at least one element, such as a seat, a shank cushion, a back cushion or a backrest, relative to the frame unit 7, 7' so as to align his joint with the cap 801, 801'. However, because the cap 801, 801' is spaced apart from the body of the user, it is difficult to align the joint of the user accurately with the cap 801, 801'.

SUMMARY OF THE INVENTION

An object of this invention is to provide an exerciser which includes a light emitting element that generates a light beam for indicating a correct position of one joint of the user on the exerciser.

According to this invention, an exerciser includes a seat attached to a supporting frame unit, and a swing rod disposed pivotally on the supporting frame unit and adapted to be swung by a portion of a human body so as to rotate synchronously with the portion of the human body about a rotating axis. A light emitting element is mounted on an assembly of the supporting frame unit and the swing rod so as to generate a light beam that extends along the rotating axis. When the human body sits on the seat, the portion of the human body can move on the supporting frame unit so as to align the light beam accurately with the rotating axis of one joint of the human body, about which the portion of the human body rotates.

BRIEF DESCRIPTION OF THE DRAWINGS

These and other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
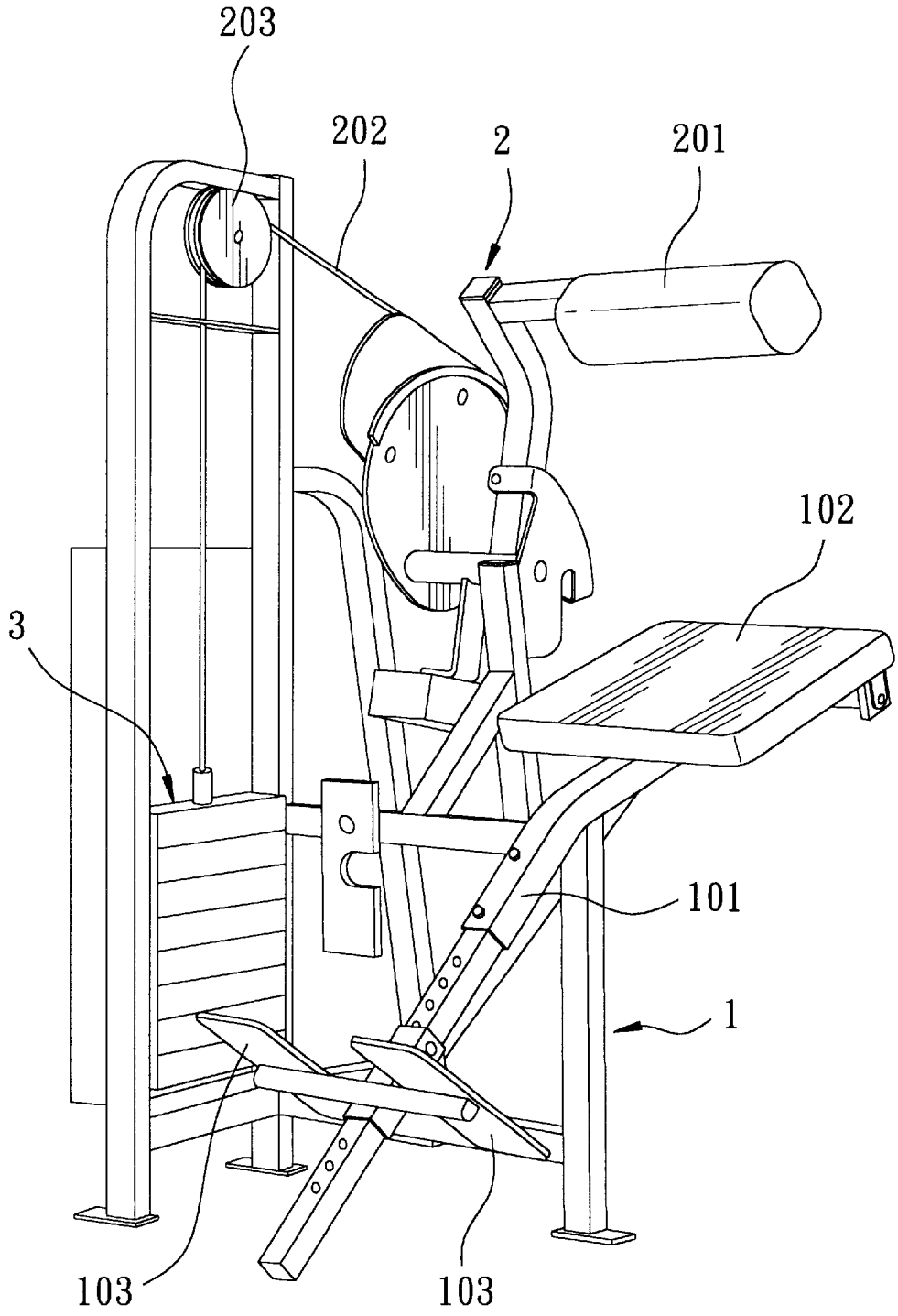
FIG. 1 PRIOR ART
FIG. 1 is a perspective view of a conventional back extension machine.
Figure 2:
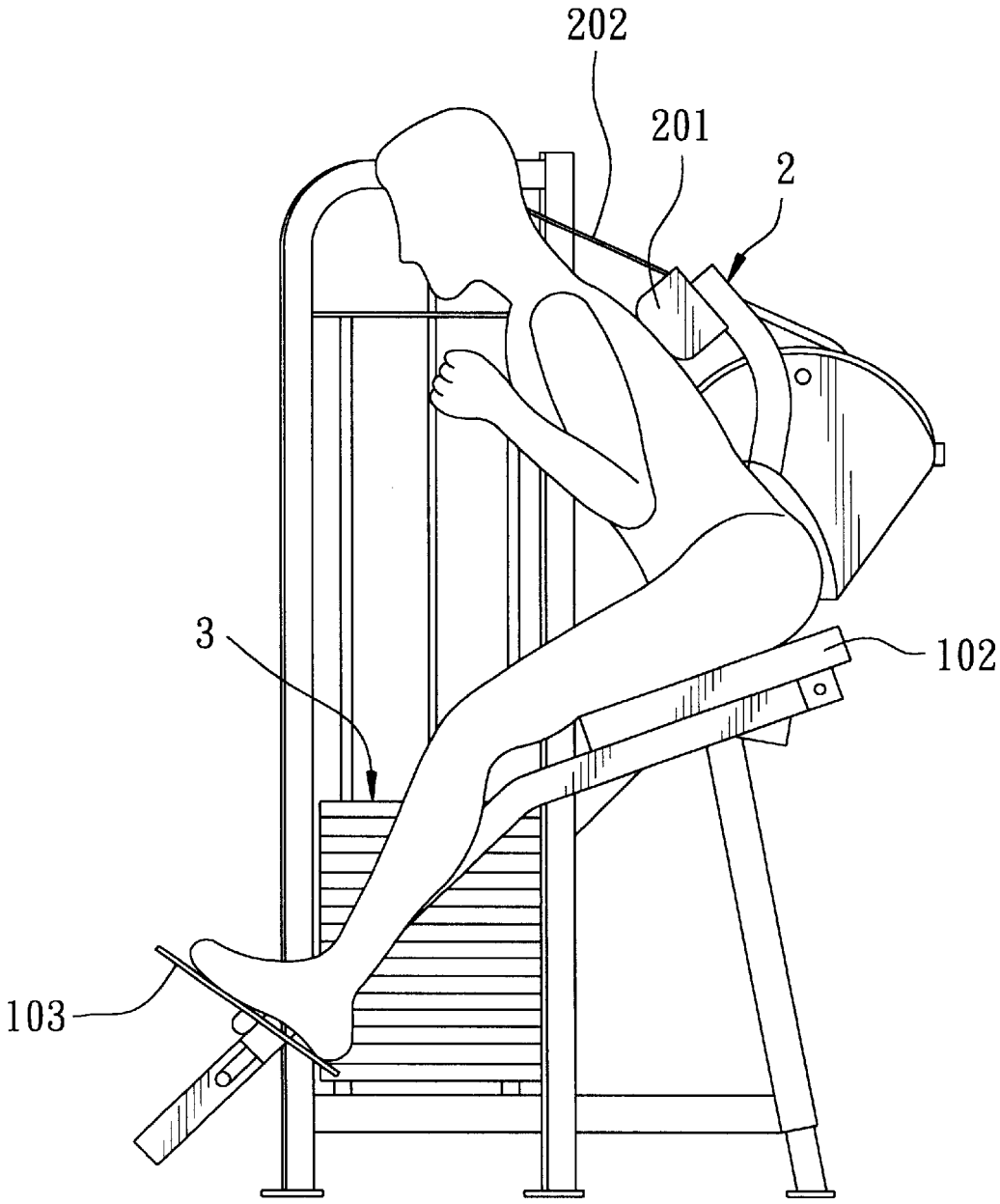
FIG. 2 PRIOR ART
FIGS. 2 and 3 are schematic views of the conventional back extension machine, illustrating how a swing rod is turned in order to pull a counterweight unit upwardly.
Figure 3:
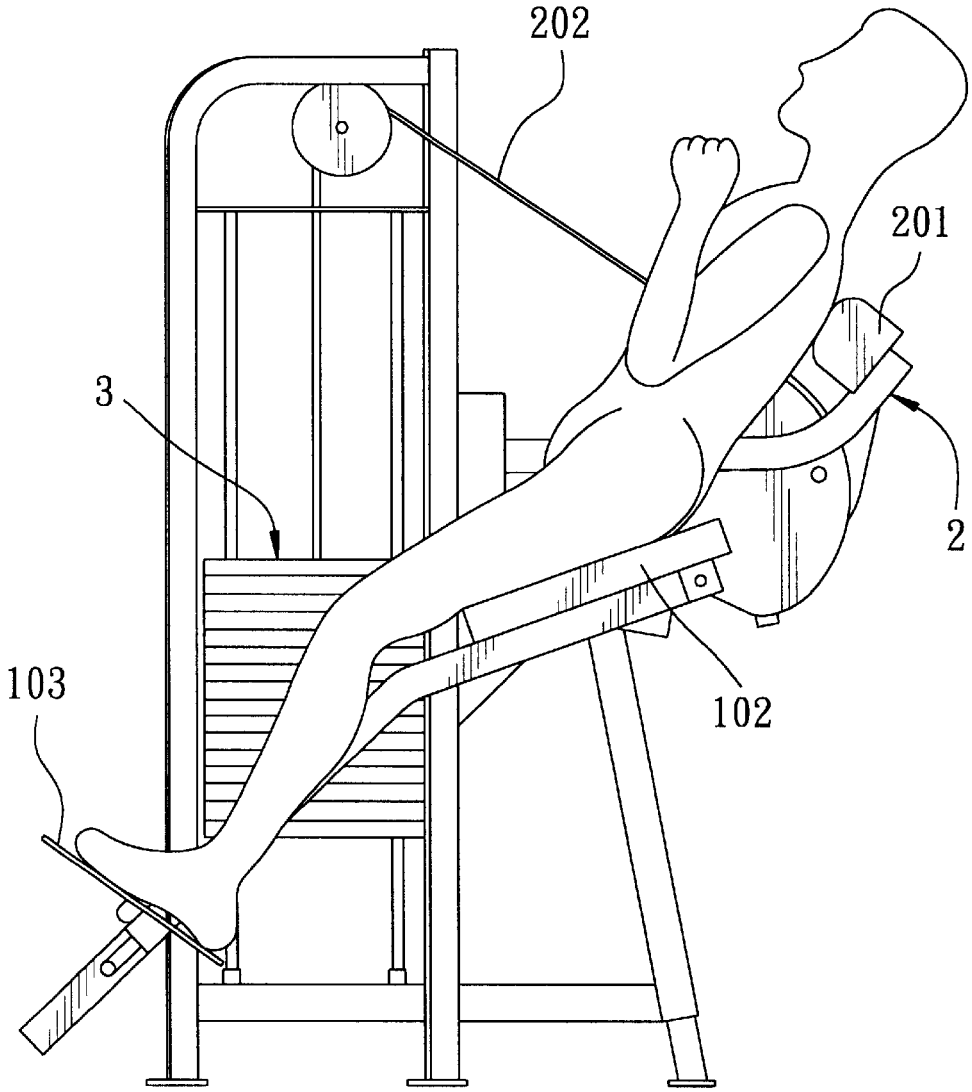
FIG. 3 PRIOR ART
Figure 4:
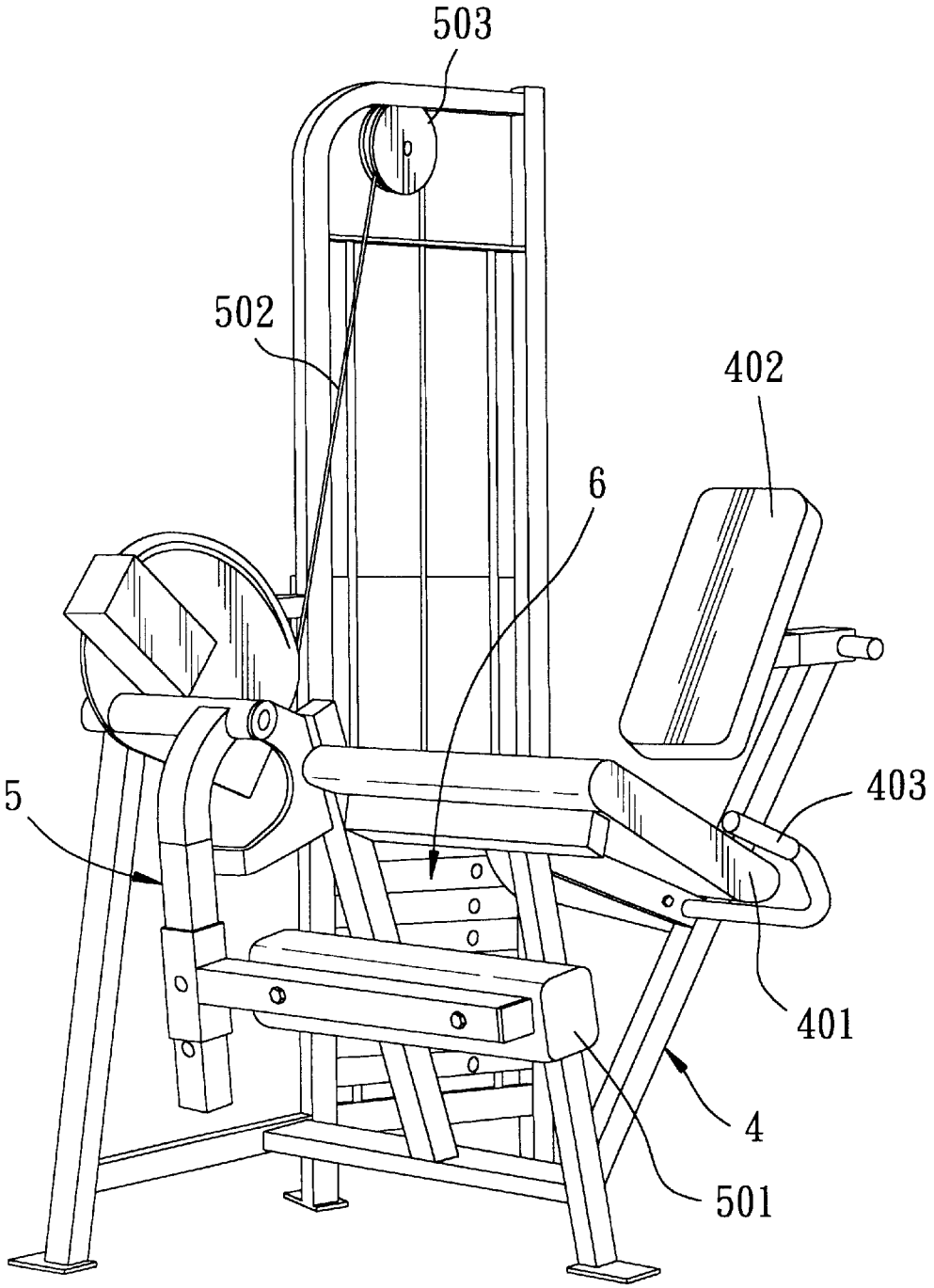
FIG. 4 PRIOR ART
FIG. 4 is a perspective view of a conventional leg extension machine.
Figure 5:
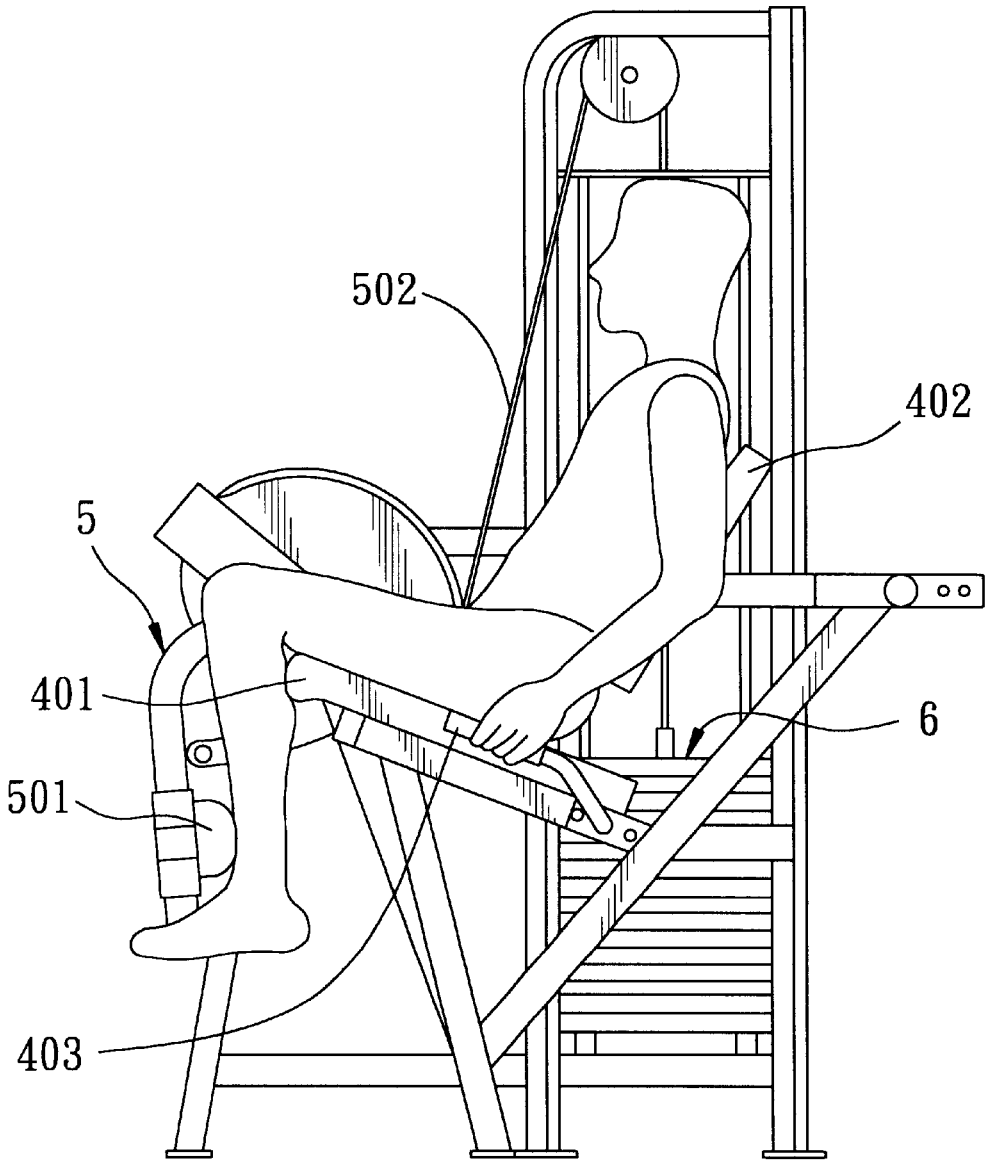
FIG. 5 PRIOR ART
FIGS. 5 and 6 are schematic views of the conventional leg extension machine, illustrating how a swing rod is turned in order to pull a counterweight unit upwardly.
Figure 6:
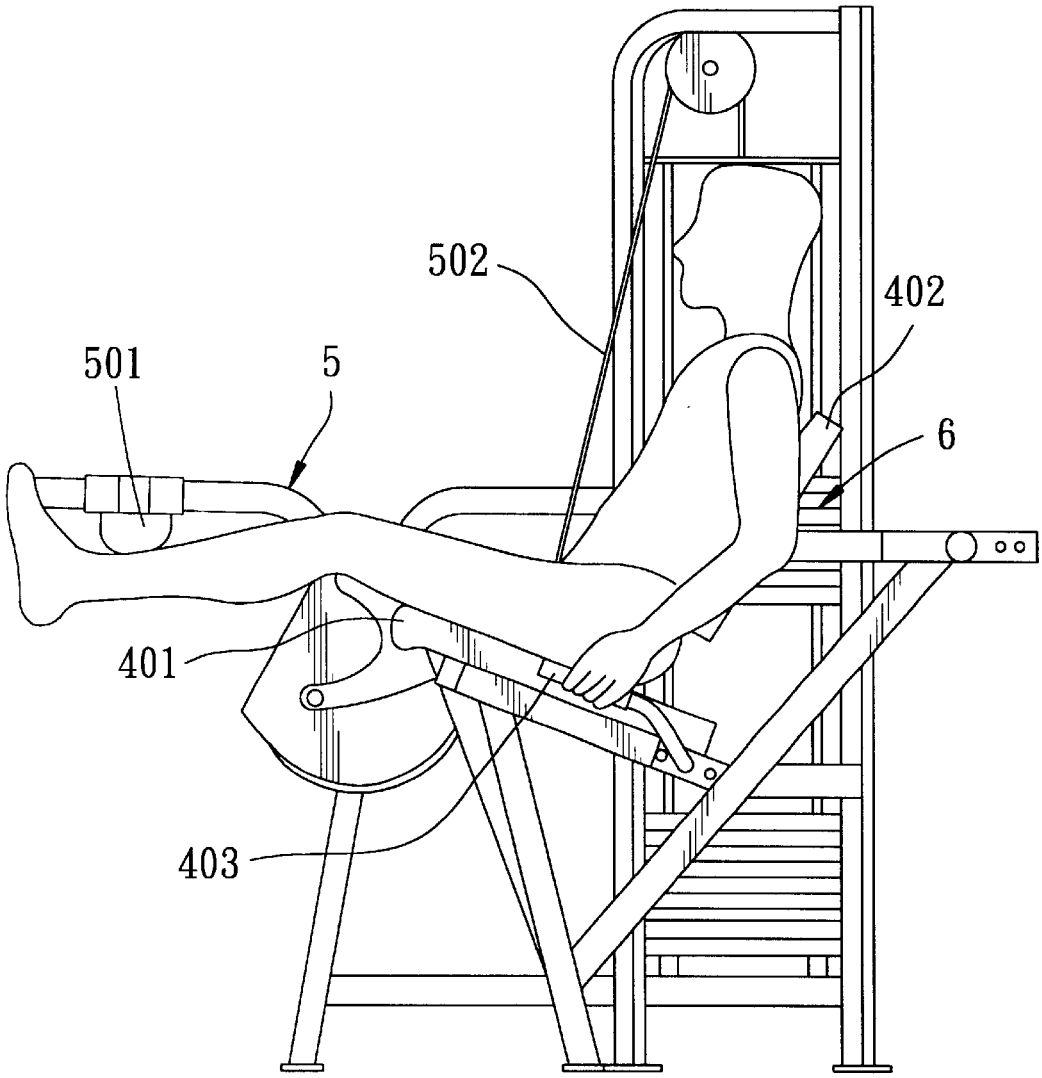
FIG. 6 PRIOR ART
Figure 7:
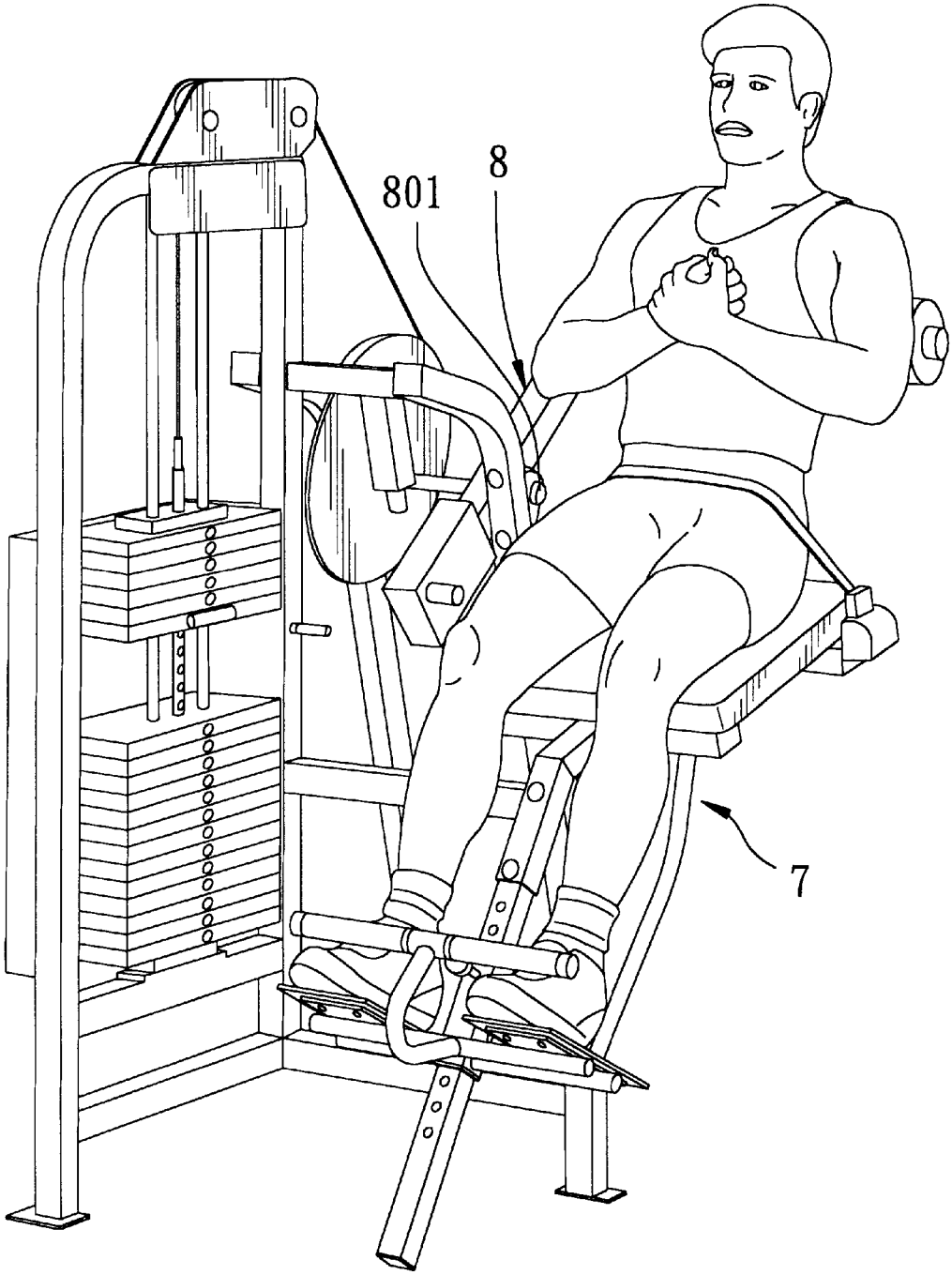
FIG. 7 PRIOR ART
FIG. 7 is a perspective view of another conventional back extension machine.
Figure 8:
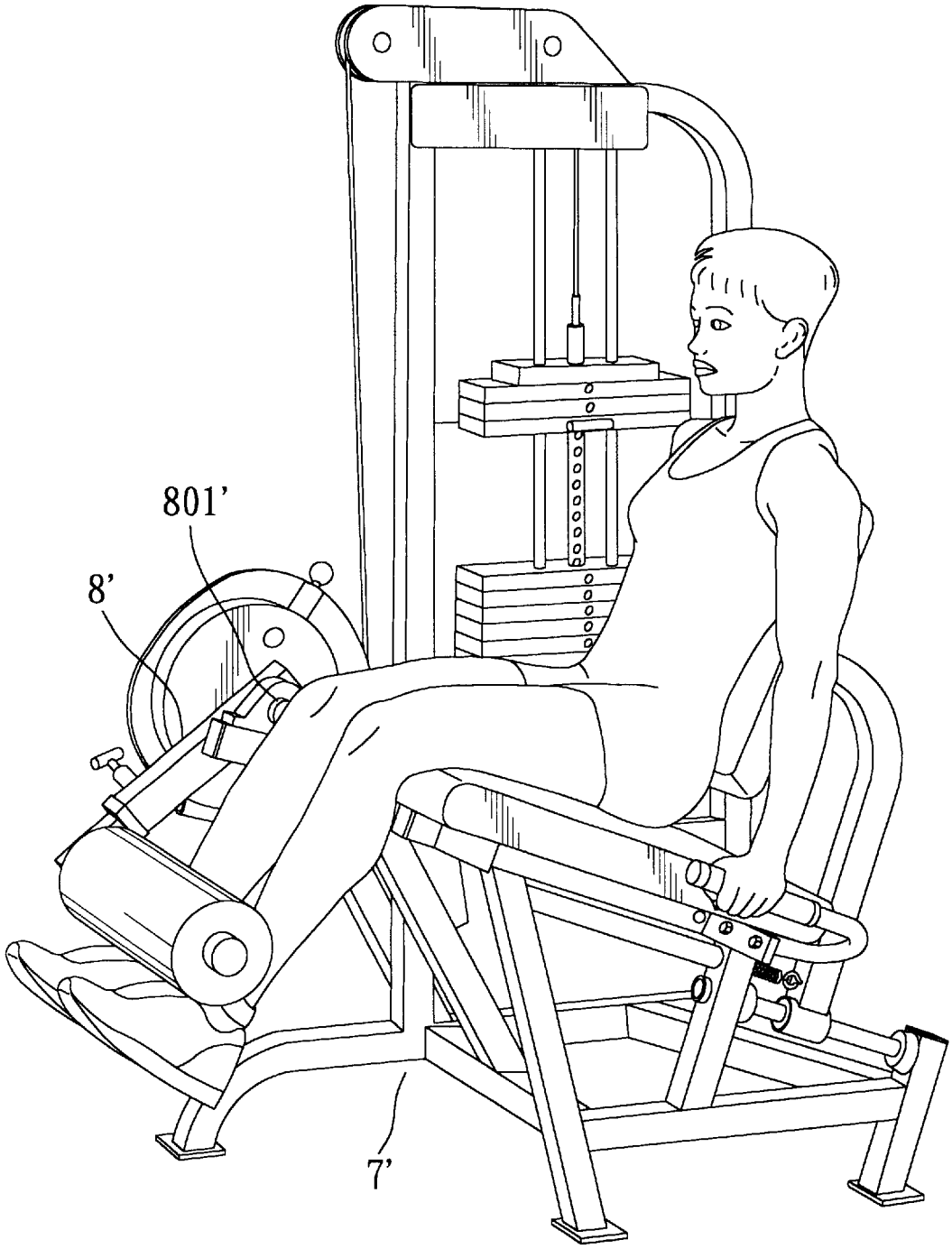
FIG. 8 PRIOR ART
FIG. 8 is a perspective view of another conventional leg extension machine.
Figure 9:
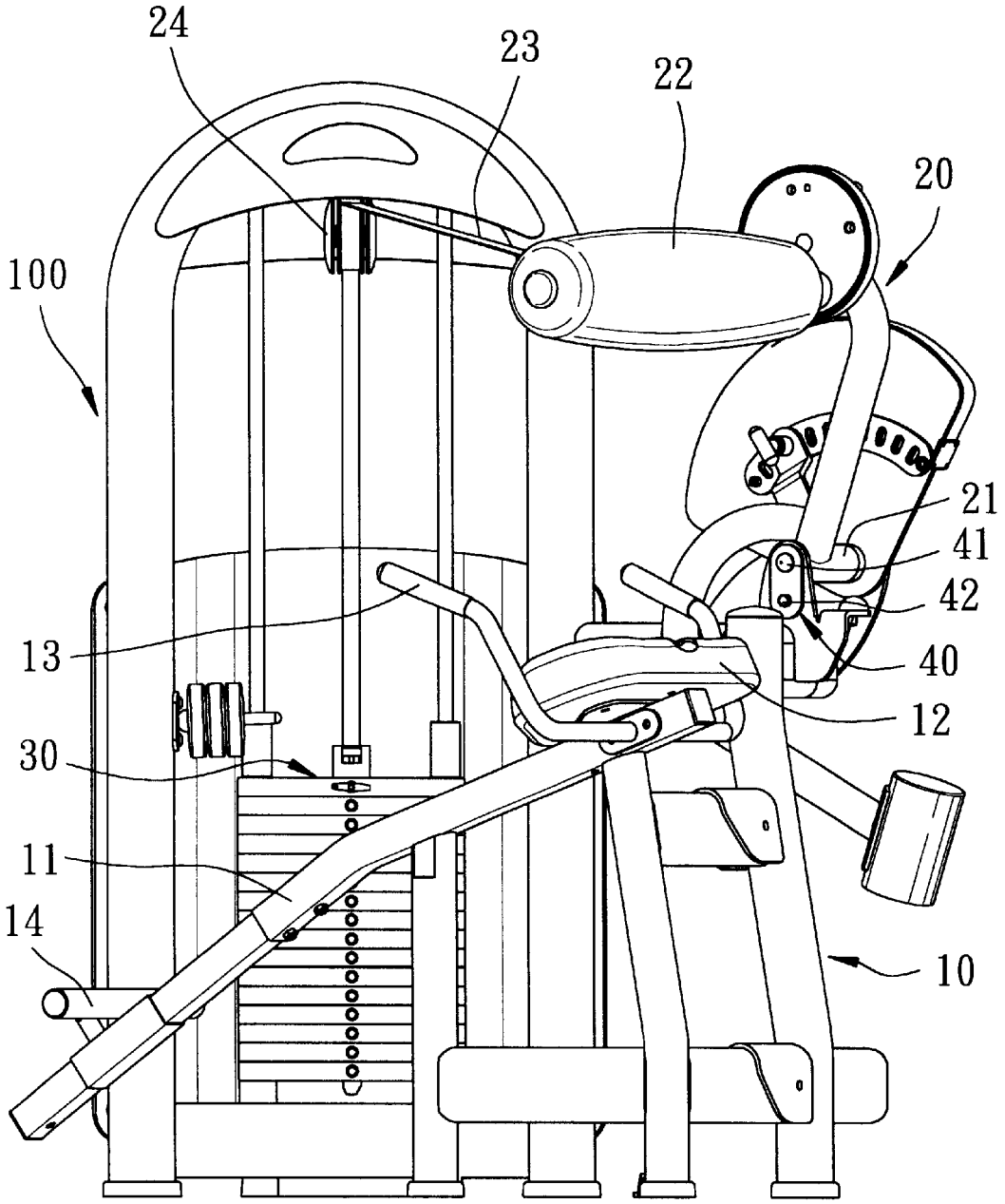
FIG. 9 is a perspective view of a first preferred embodiment of an exerciser according to this invention, which is constructed as a back extension machine.
Figure 10:
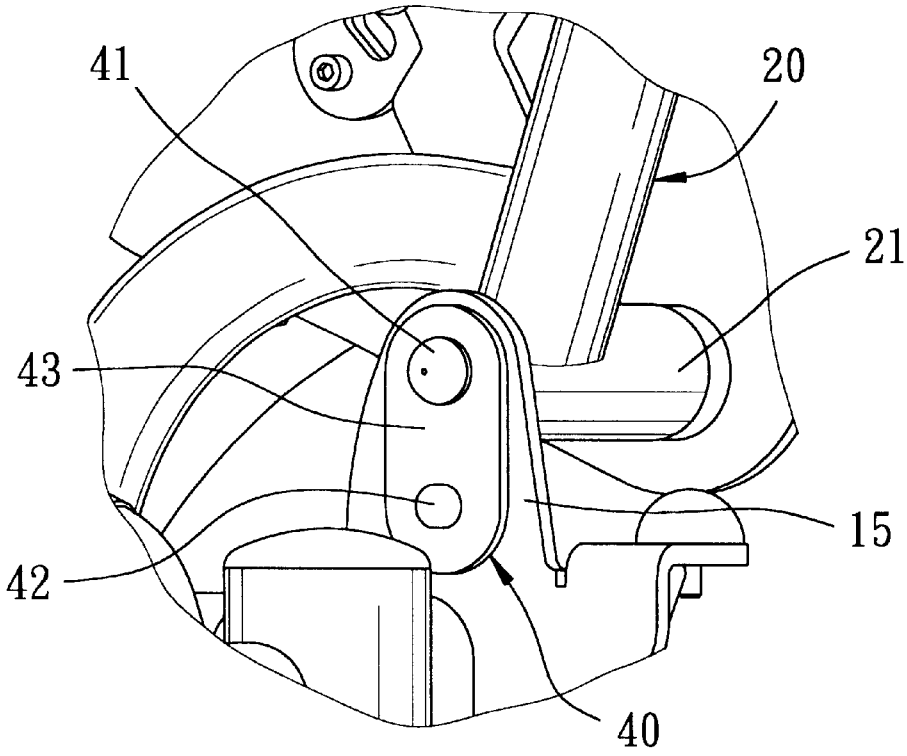
FIG. 10 is a fragmentary perspective view of the first preferred embodiment, illustrating how a light emitting element is disposed relative to a rotating shaft of a swing rod.

Referring to FIGS. 9 and 10, a first preferred embodiment of an exerciser according to this invention is constructed as a back extension machine 100, and is shown to include a supporting frame unit 10, a swing rod 20, a counterweight unit 30 and a position-indicating device 40.

The frame unit 10 has a brace 11 that supports a seat 12 fixedly on an upper end thereof. Two handle members 13 are fixed to the brace 11, and are disposed on two sides of the seat 12. A foot rail 14 is disposed on a lower end portion of the brace 11.

The swing rod 20 is provided with a rotating shaft 21 that is journalled on the frame unit 10 at an end thereof, and a fixed back cushion 22 that is located above the seat 12. A pull rope 23 extends around a pulley 24, and is fastened to the swing rod 20 at one end, and to the counterweight unit 30 at another end.

The position-indicating device 40 includes a light emitting element 41, such as a laser light-emitting diode, and a push-button type switch 42, which are disposed on a plate body 43 that is fixed on a mounting plate 15 of the frame unit 10. A battery (not shown) is disposed on the plate body 43 for supplying electricity to the device 40. When the switch 42 is depressed, a laser light beam is generated continuously from the light emitting element 41, and advances along the rotating axis of the rotating shaft 21. Alternatively, the switch 42 can be connected electrically to the light emitting element 41 in such a manner that the latter can only generate the laser light beam for a predetermined time period upon actuation of the switch 42.

Figure 11:
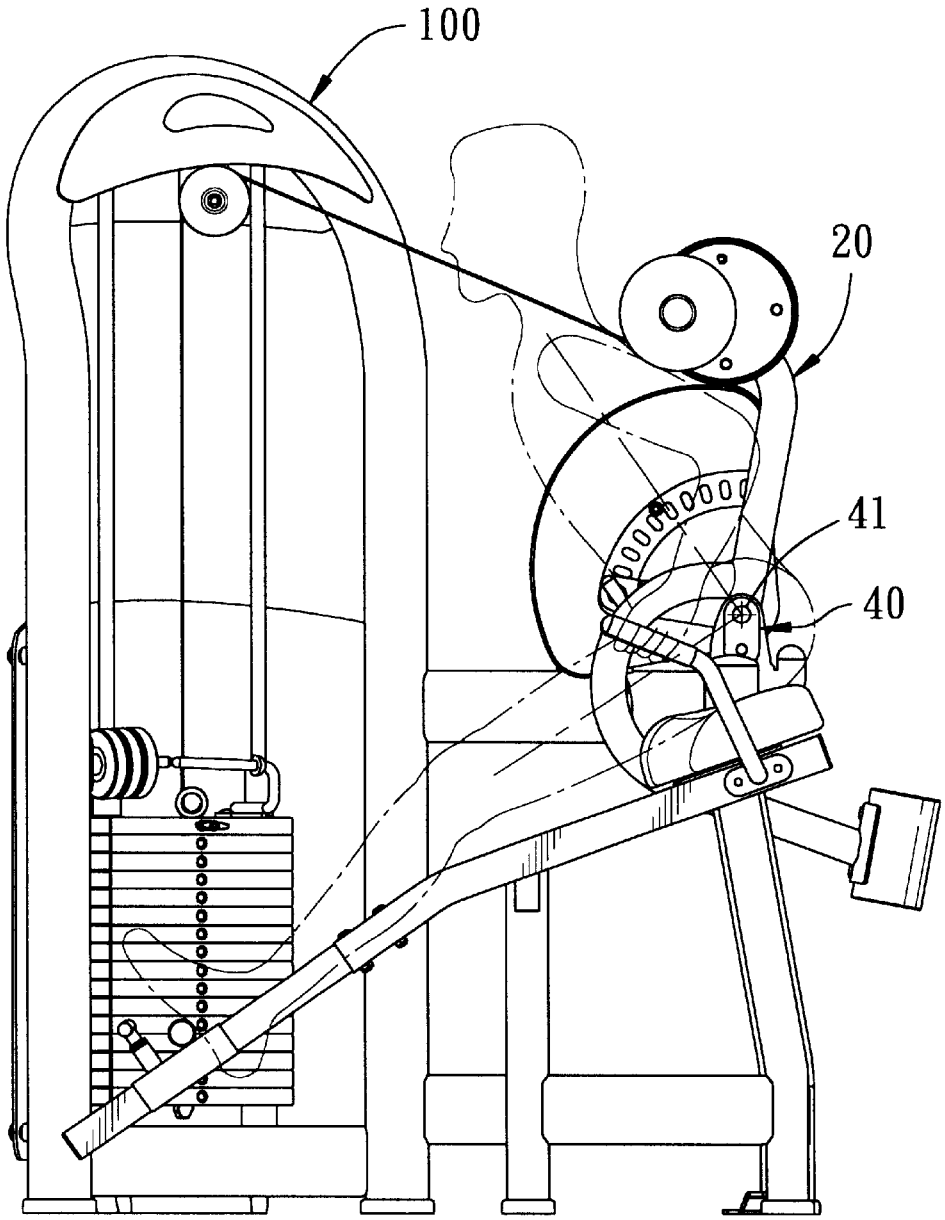
FIGS. 11 and 12 are schematic side and rear views of the first preferred embodiment, illustrating the operation of the swing rod.
Figure 12:
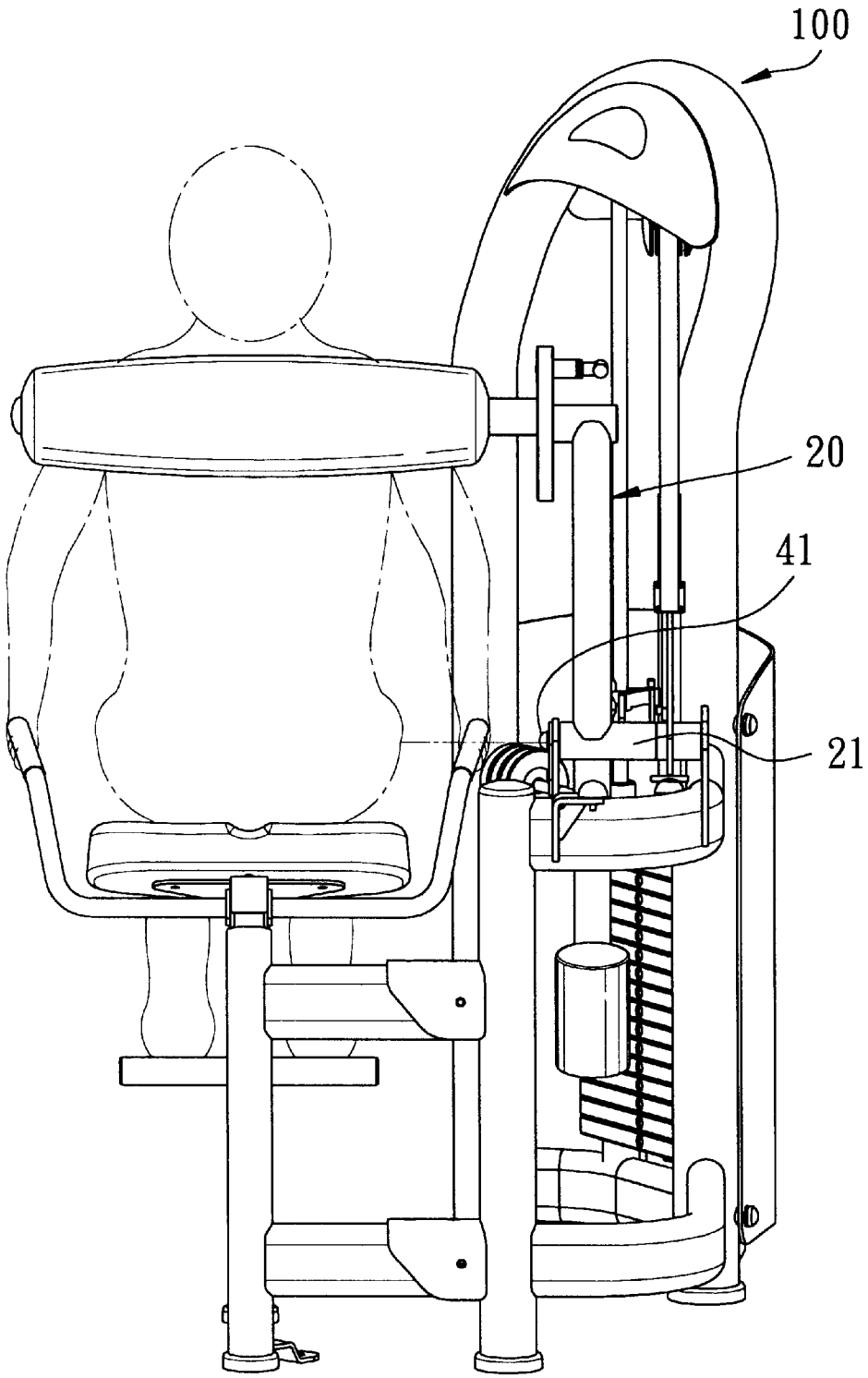

With further reference to FIGS. 11 and 12, the user sits on the seat 12 in such a manner that his feet rest on the foot rail 14. The hands of the user hold the handle members 13, respectively. The back of the user abuts against the back cushion 22 so that the former can press and turn the latter rearwardly and downwardly, thereby pulling the counterweight unit 30 upwardly. When the switch 42 is actuated to generate the light beam that is projected onto and that forms a red circular point (not shown) on the body of the user, the body of the user can be moved relative to the frame unit 10 by adjusting the positions of the seat 12, the foot rail 14 and the back cushion 22 relative to the frame unit 10 so as to align his back joint accurately with the red circular point, thereby correcting the posture of the user such that the back joint is properly coordinated with the rotating axis of the swing rod 20, thus avoiding injury to the back muscles and the back joint of the user during the back extension operation. Because the position adjustment of the seat 12, the foot rail 14 and the back cushion 22 is not pertinent to the claimed invention, a description thereof will be omitted herein for the sake of brevity.

Figure 13:
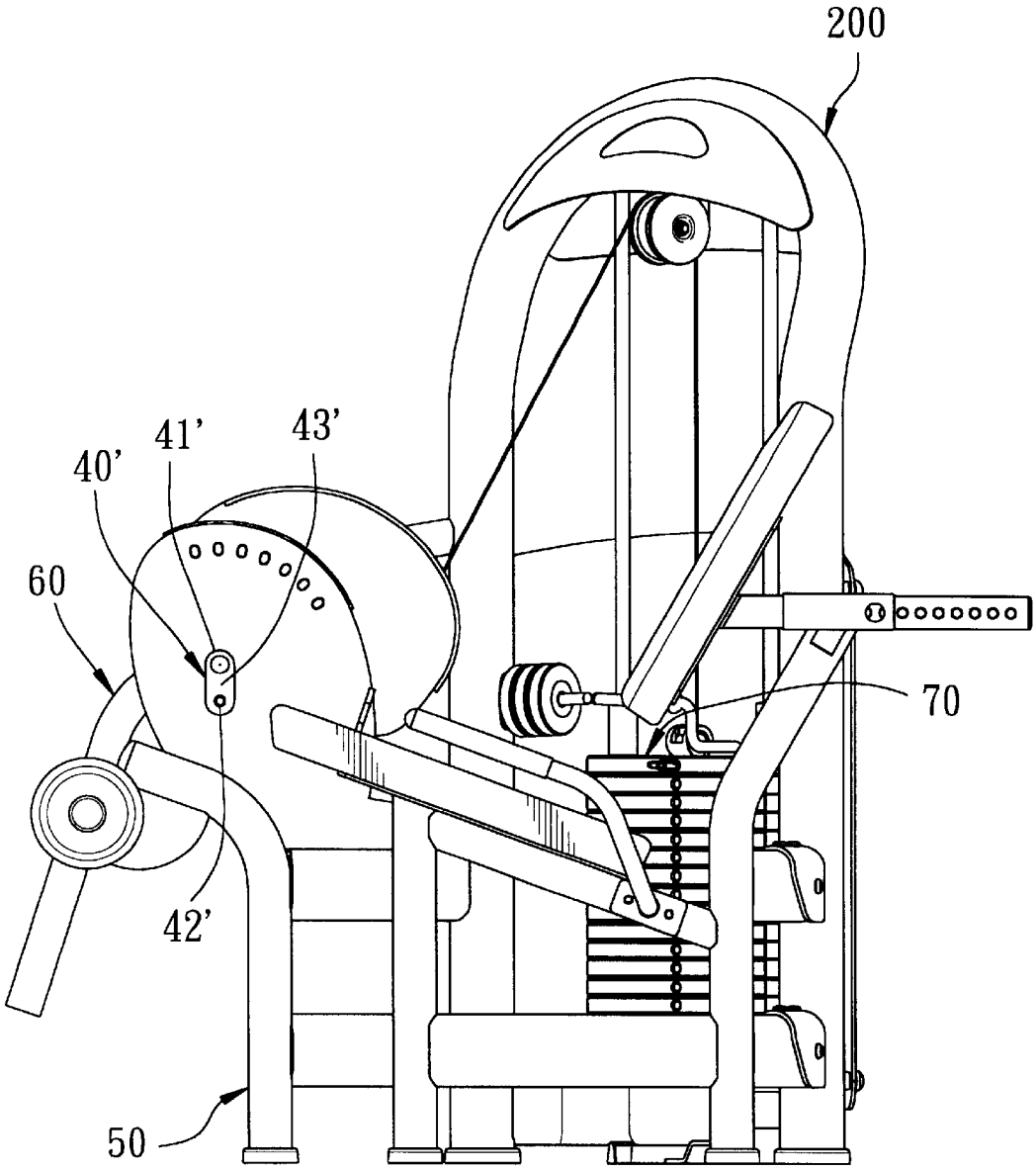
FIGS. 13 and 14 are schematic side and front views of a second preferred embodiment of an exerciser according to this invention, which is constructed as a leg extension machine.
Figure 14:
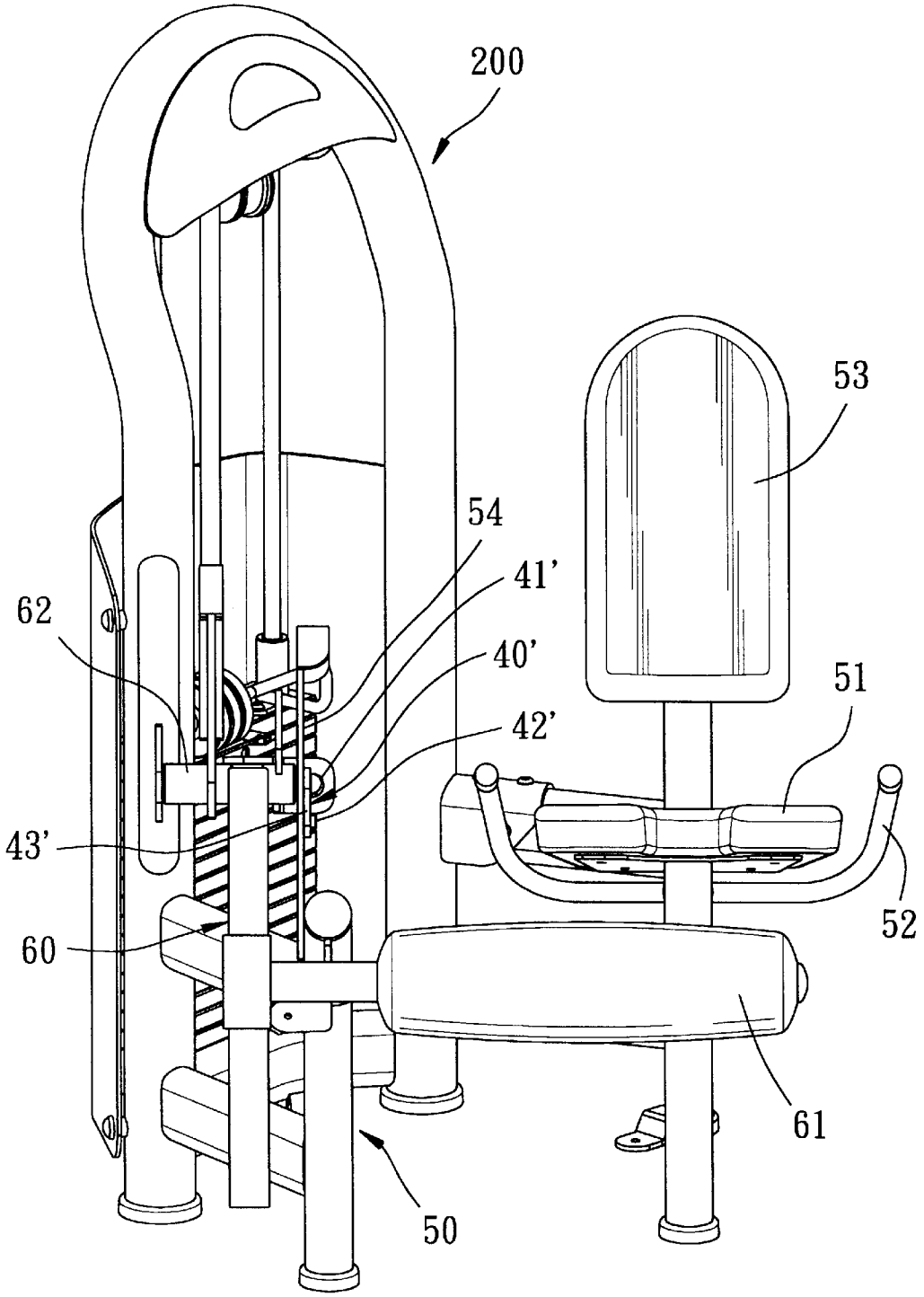

Referring to FIGS. 13 and 14, a second preferred embodiment of an exerciser according to this invention is constructed as a leg extension machine 200, and is shown to include a supporting frame unit 50, a swing rod 60, a counterweight unit 70 and a position-indicating device 40'.

The frame unit 50 is provided with a fixed seat 51, two fixed handle members 52 and a fixed backrest 53. The swing rod 60 is provided with a fixed shank cushion 61 that is disposed below the seat 51. The position indicating device 40' is similar to that of the first preferred embodiment in construction, and includes a light emitting element 41', a switch 42' and a plate body 43'. The plate body 43' is attached to a mounting plate 54 of the frame unit 50, which is disposed adjacent to an end of a rotating shaft 62 that is provided on the swing rod 60. The rotating shaft 62 has a rotating axis that extends through the light emitting element 41'. As such, the body of the user can be moved by adjusting the positions of the seat 51, the backrest 53 and the shank cushion 61 relative to the frame unit 50, thereby permitting accurate alignment of the knee joint of the user with the light beam that is emitted from the light emitting element 41'.

With this invention thus explained, it is apparent the numerous modifications and variations can be made without departing from the scope and spirit of this invention. It is therefore intended that this invention be limited only as indicated in the appended claims.

I claim:

1. An exerciser comprising:

a supporting frame unit;

a seat attached to said supporting frame unit and adapted to permit sitting of a human body thereon;

a swing rod disposed pivotally on said supporting frame unit and adapted to be swung by a portion of the human body so as to rotate synchronously with the portion of the human body about a rotating axis; and a light emitting element mounted on assembly of said supporting frame unit and said swing rod so as to generate a light beam that extends along said rotating axis;

whereby, when the human body sits on said seat, the portion of the human body can move on said supporting frame unit so as to align said light beam accurately with a rotating axis of one joint of the human body, about which the portion of the human body rotates.

2. The exerciser as claimed in claim 1, wherein said swing rod includes a rotating shaft that is journalled on said supporting frame unit, said light emitting element being attached to said frame unit near an end of said rotating shaft and being aligned with a rotating axis of said rotating shaft.

3. The exerciser as claimed in claim 1, further comprising a pushbutton type switch that is connected electrically to and that is disposed adjacent to said light emitting element for controlling generation of said light beam.

4. The exerciser as claimed in claim 3, wherein said light emitting element generates continuously said light beam upon actuation of said switch.

5. The exerciser as claimed in claim 3, wherein said light emitting element generates said light beam for a predetermined timr period upon actuation of said switch.

6. The exerciser as claimed in claim 1, wherein said swing rod is disposed above said seat, and is provided with a fixed back cushion that is located above said seat so that said exerciser serves as a back extension machine.

7. The exerciser as claimed in claim 1, wherein said swing rod is provided with a fixed shank cushion that is disposed below said seat when said swing rod is not actuated, so that said exerciser serves as a leg extension machine.

8. The exerciser as claimed in claim 1, wherein said light emitting element is constructed as a laser light-emitting diode.

* * * * *